US008564521B2

(12) United States Patent
Cho

(10) Patent No.: US 8,564,521 B2
(45) Date of Patent: Oct. 22, 2013

(54) DATA PROCESSING DEVICE, METHOD OF DRIVING THE SAME AND DISPLAY DEVICE HAVING THE SAME

(75) Inventor: Hyun-Sang Cho, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 1947 days.

(21) Appl. No.: 11/517,160

(22) Filed: Sep. 7, 2006

(65) Prior Publication Data

US 2007/0195046 A1 Aug. 23, 2007

(30) Foreign Application Priority Data

Feb. 17, 2006 (KR) ..... 10-2006-0015822

(51) Int. Cl.
*G09G 3/36* (2006.01)

(52) U.S. Cl.
USPC ..... 345/98; 345/690

(58) Field of Classification Search
USPC ..... 345/87–104, 690, 204
See application file for complete search history.

(56) References Cited

U.S. PATENT DOCUMENTS

2004/0196274 A1* 10/2004 Song et al. ..... 345/204
2005/0001802 A1* 1/2005 Lee ..... 345/89
2005/0093803 A1* 5/2005 Cheon et al. ..... 345/92

FOREIGN PATENT DOCUMENTS

| | | | |
|---|---|---|---|
| CN | 1571008 | | 1/2005 |
| CN | 1664907 | | 9/2005 |
| JP | 2002-099249 | A | 4/2002 |
| JP | 2002-351409 | A | 12/2002 |
| JP | 2004-310113 | A | 11/2004 |
| JP | 2005-049840 | A | 2/2005 |
| JP | 2005-141216 | A | 6/2005 |
| KR | 1020050024071 | A | 3/2005 |
| KR | 1020050041463 | A | 5/2005 |

* cited by examiner

*Primary Examiner* — Jimmy H Nguyen
(74) *Attorney, Agent, or Firm* — Cantor Colburn LLP

(57) ABSTRACT

A display device having a data processing section includes a memory, a first compensation section and a second compensation section. The memory outputs first compensated data based on first frame data. The first compensation section generates second compensated data based on the first compensated data and second frame data, while storing the second compensated data in the memory after the memory outputs the first compensated data. The second compensation section generates third compensated data based on the second frame data and the first compensated data. In the display device, liquid crystals provide an improved response time. Also, a reduced number of memory elements can be embedded in the data processing section.

16 Claims, 4 Drawing Sheets

DATA PROCESSING DEVICE, METHOD OF DRIVING THE SAME AND DISPLAY DEVICE HAVING THE SAME

This application claims priority to Korean Patent Application No. 2006-15822, filed on Feb. 17, 2006, and all the benefits accruing therefrom under 35 USC §119, the contents of which in its entirety are herein incorporated by reference.

BACKGROUND OF THE INVENTION

1. Field of the Invention

The present invention relates to a display device. More particularly, the present invention relates to a data processing device capable of improving a response speed of liquid crystal, a method of driving the data processing device, and a display device having the data processing device.

2. Description of the Related Art

A liquid crystal display device generally includes two display substrates and a liquid crystal layer interposed between the two display substrates. In such a liquid crystal display device, an electric field is applied to the liquid crystal layer and an intensity of the electric field is controlled so as to adjust a transmittance of light passing through the liquid crystal layer, thereby displaying desired images.

As liquid crystal display devices have been widely used for display screens of televisions, as well as computers, realization of moving picture or video images in the liquid crystal display devices has been increasingly required. However, because conventional liquid crystal display devices present a low response speed, such video images may not be effectively realized in current liquid crystal display devices.

More specifically, since liquid crystal molecules present a low response speed, a certain period of time is necessary to charge a liquid crystal capacitor with a target voltage (e.g., a voltage at which a desired luminance can be obtained). Such a time delay depends on a potential difference between the target voltage and a previous voltage, which has already been charged in the liquid crystal display device in a previous frame.

However, if the potential difference between the target voltage and the previous voltage is large enough, application of the target voltage from a starting point may inhibit the liquid crystal capacitor from ever reaching the target voltage within a period of 1 H (e.g., within one frame period) during which a switching element is maintained in a turn-on state.

BRIEF SUMMARY OF THE INVENTION

Therefore, the present invention provides a data processing device, which can improve a response speed of liquid crystal and reduce a number of memory elements.

The present invention also provides a method suitable for driving the above data processing device.

In addition, the present invention provides a display device having the above data processing device.

In an exemplary embodiment of the present invention, the data processing device includes a memory, a first compensation section and a second compensation section. The memory outputs first compensated data based on first frame data. The first compensation section generates second compensated data based on the first compensated data and second frame data, while storing the second compensated data in the memory after the memory outputs the first compensated data. The second compensation section generates third compensated data based on the second frame data and the first compensated data.

In another exemplary embodiment of the present invention, a method of driving the data processing device is provided as follows. The data processing device reads out the first compensated data based on the first frame data and receives the second frame data. Next, the data processing device generates the second compensated data based on the second frame data and the first compensated data, and stores the second compensated data. Then, the data processing device generates the third compensated data based on the second frame data and the first compensated data.

In still another exemplary of the present invention, the display device includes a data processing section, a data driving section, a gate driving section and a display section. The data processing section generates the second compensated data based on the first compensated data obtained by compensation of first frame data and on the second frame data. Also, the data processing section generates the third compensated data based on the second frame data and the first compensated data. The data driving section outputs a data voltage corresponding to the third compensated data in response to data control signals. The gate driving section outputs a gate voltage in response to gate control signals. The display section displays images in response to the data voltage and the gate voltage.

According to the above, the third compensated data is generated based on the first compensated data obtained by compensating the first frame data and the second frame data, so that the response time of liquid crystals can be improved, while reducing the number of memories.

BRIEF DESCRIPTION OF THE DRAWINGS

The above and other aspects, features and advantages of the present invention will become readily apparent by reference to the following detailed description when considered in conjunction with the accompanying drawings wherein.

DETAILED DESCRIPTION OF THE INVENTION

Figure 1:
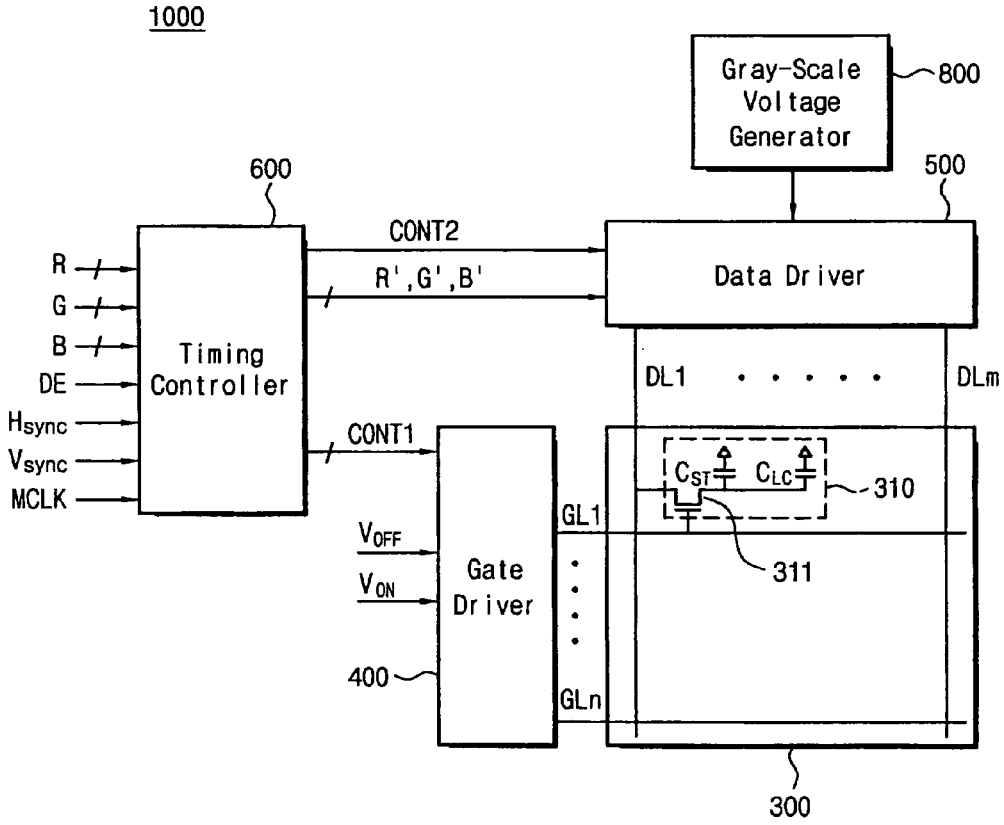
FIG. 1 is a block diagram illustrating an exemplary embodiment of a liquid crystal display device according to the present invention.

Reference will now be made in detail to the exemplary embodiments of the present invention, examples of which are illustrated in the accompanying drawings. However, the present invention is not limited to the exemplary embodiments illustrated hereinafter, and the exemplary embodiments herein are rather introduced to provide easy and complete understanding of the scope and spirit of the present invention. Therefore, the present invention should not be construed as being limited to the exemplary embodiments set forth herein. Like reference numerals in the drawings denote like elements.

The terminology used herein is for the purpose of describing particular exemplary embodiments only and is not intended to be limiting of the present invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating a liquid crystal display device according to an exemplary embodiment of the present invention.

Referring to FIG. 1, a liquid crystal display device 100 includes a display section 300 which displays images, a gate driver 400 and a data driver 500 driving the display section 300, a gray-scale voltage generator 800 connected to the data driver 500, and a timing controller 600 that controls the gate driver 400 and the data driver 500.

The display section 300 includes a plurality gate lines GL1~GLn receiving a gate voltage, and a plurality of data lines DL1~DLm receiving a data voltage. A plurality of pixel regions in a matrix configuration is defined in the display section 300 by the gate lines GL1~GLn and data lines DL1~DLm, in which each pixel region has a pixel 310. The pixel 310 includes a thin film transistor 311, a liquid crystal capacitor $C_{LC}$ and a storage capacitor $C_{ST}$.

As shown in FIG. 1, a gate electrode of the thin film transistor 311 is connected to the first gate line GL1, a source electrode of the thin film transistor 311 is connected to the first data line DL1, and the liquid crystal capacitor $C_{LC}$ and the storage capacitor $C_{ST}$ are connected in parallel to each other to a drain electrode of the thin film transistor 311.

In the present exemplary embodiment, the display section 300 includes a lower display substrate, an upper display substrate facing the lower display substrate, and a liquid crystal layer interposed between the lower display substrate and the upper display substrate.

The gate lines GL1~GLn, the data lines DL1~DLm, the thin film transistor 311, and a pixel electrode, which is a first electrode of the liquid crystal capacitor $C_{LC}$, are formed on the lower display substrate. Therefore, the thin film transistor 311 applies the data voltage to the pixel electrode in response to the gate voltage.

Meanwhile, a common electrode, which is a second electrode of the liquid crystal capacitor $C_{LC}$, is formed on the upper display substrate, and a common voltage is applied to the common electrode. The liquid crystal layer interposed between the pixel electrode and the common electrode serves as a dielectric layer. Therefore, the liquid crystal capacitor $C_{LC}$ is charged with a voltage corresponding to the potential difference between the data voltage and the common voltage.

The gate driver 400 is electrically connected with the gate lines GL1~GLn formed on the display section 300 and supplies the gate voltage to the gate lines GL1~GLn. The data driver 500 is electrically connected with the data lines DL1~DLm formed on the display section 300, and selects a gray scale voltage generated from the gray-scale voltage generator 800 and supplies the selected gray scale voltage to the data lines DL1~DLm as the data voltage.

The timing controller 600 receives a first image signal R, G, B and various 4control signals, such as a vertical synchronous signal Vsync, a horizontal synchronous signal Hsync, a main clock signal MCLK and a data enabling signal DE, from an external graphic controller (not shown). The timing controller 600 processes the first image signal R, G, B to output a second image signal R', G', B', and outputs a gate control signal CONT1 and a data control signal CONT2 based on the above control signals.

The gate control signal CONT1 is supplied to the gate driver 400 in order to control the operation of the gate driver 400. The gate control signal CONT1 includes a vertical start signal by which the gate driver 400 starts to operate, a gate clock signal by which an output time of the gate voltage is determined, and an output enable signal by which an on-pulse width of the gate voltage is determined.

The gate driver 400 outputs the gate voltage including the combination of a gate on voltage (Von) and a gate off voltage (Voff) in response to the gate control signal CONT1 output from the timing controller 600.

The data control signal CONT2 is supplied to the data driver in order to control the operation of the data driver 500. The data control signal CONT2 includes a horizontal start signal by which the data driver 500 starts to operate, an inversion signal by which a polarity of the data voltage is inverted, and an output indicating signal by which an output time of the data voltage is determined.

The data driver 500 receives the second image signal R', G', B' corresponding to a row of pixels, in response to the data control signal CONT1 output from the timing controller 600. Also, the data driver 500 selects the gray scale voltage corresponding to the second image signal R', G', B' from among the gray scale voltages generated from the gray-scale voltage generator 800, and outputs the gray scale voltage after converting the selected gray scale voltage into the data voltage.

The timing controller 600 further includes a data processing section to improve the response time of the liquid crystals. Hereinafter, the data processing section will be explained in more detail with reference to FIGS. 2 to 4.

Figure 2:
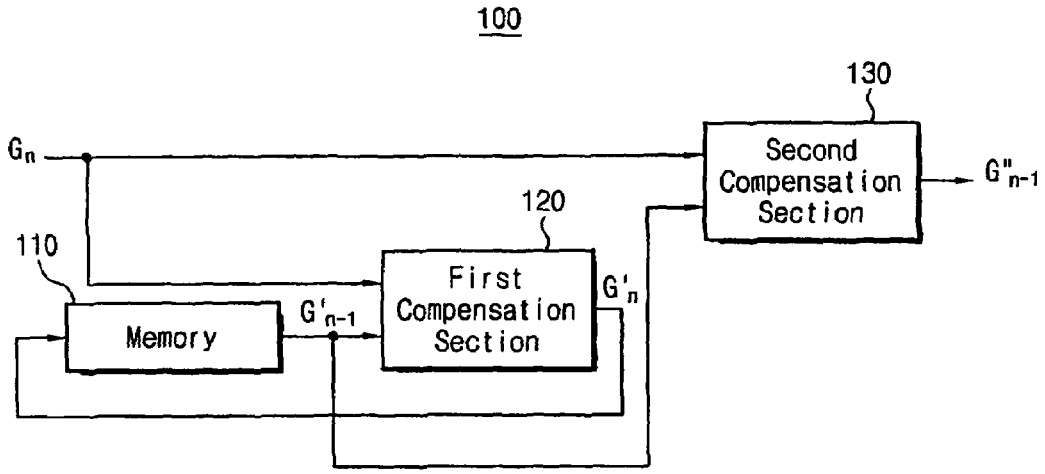
FIG. 2 is a block diagram illustrating an exemplary embodiment of a data processing section according to the present invention.
Figure 3:
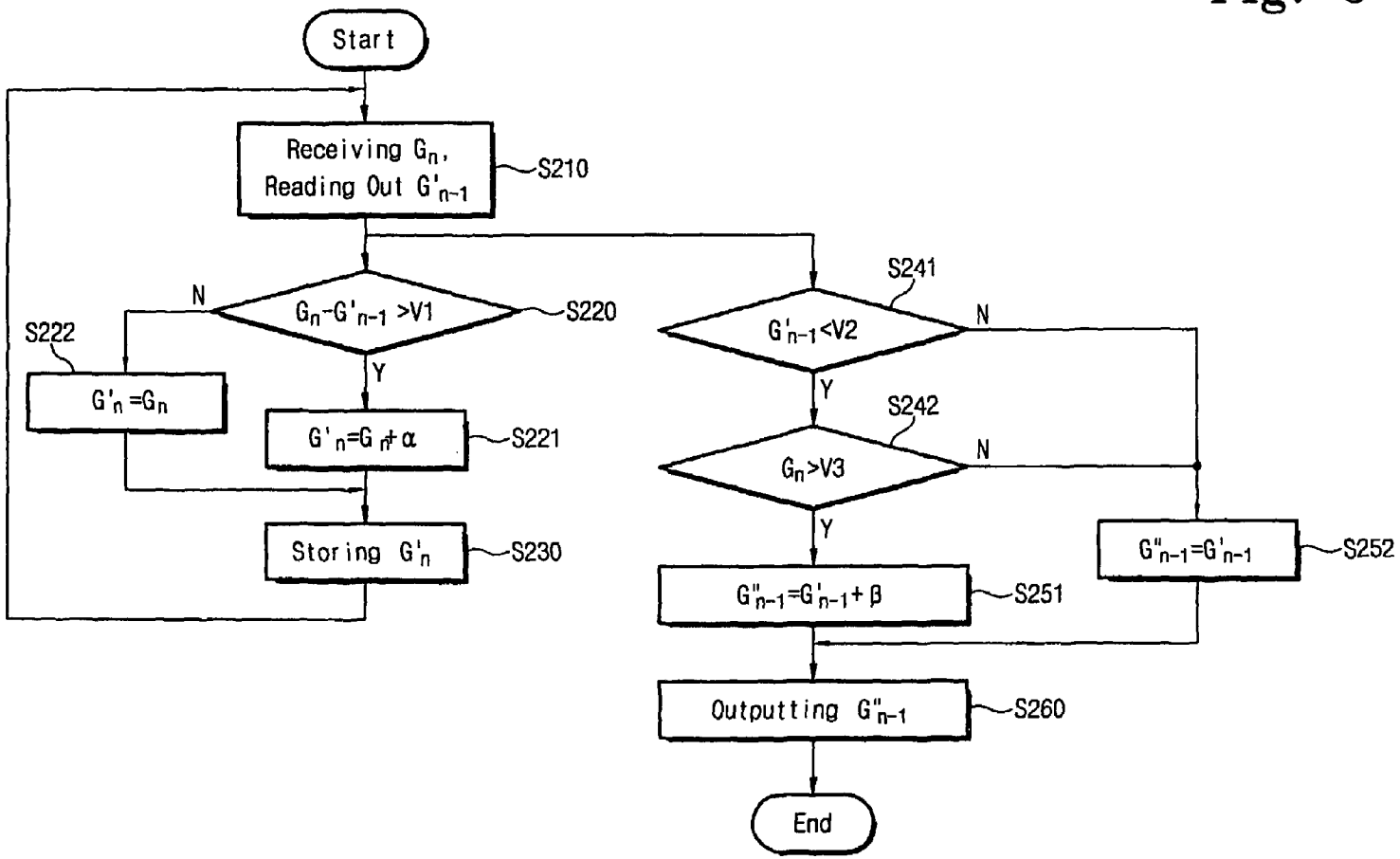
FIG. 3 is a flow chart illustrating an operational procedure of the data processing section shown in FIG. 2.

FIG. 2 is a block diagram illustrating the data processing section according to an exemplary embodiment of the present invention. FIG. 3 is a flow chart illustrating the operation process of the data processing section as shown in FIG. 2

Referring to FIG. 2, the data processing section 100 includes a memory 110, a first compensation section 120 and a second compensation section 130.

The first compensation section 120 reads out a compensation signal G'n−1 (hereinafter, referred to as a first compensated signal) of a previous frame ($(n-1)^{th}$ frame), which is obtained by compensating an image signal of the $(n-1)^{th}$ frame (hereinafter, referred to as a first image signal), from the memory 110. Herein, the first compensated signal G'n−1 is generated based on both the compensated signal of a frame ($(n-2)^{th}$ frame) before the previous frame and the image signal of the $(n-1)^{th}$ frame. Additionally, the first compensation section 120 receives an image signal Gn (a second image signal) of a present frame ($n^{th}$ frame). The first compensation section 120 outputs the compensated signal G'n (hereinafter, referred to as a second compensated signal) of the present frame ($n^{th}$) based on both the first compensated signal G'n−1 and the second image signal Gn. Then, the second compensated signal G'n is fedback to the memory 110 and stored therein. Therefore, compensated signals are continuously stored in the memory 110 in one frame unit.

The second compensation section 130 outputs a third compensated signal based on both the first compensated signal G'n−1 and the second image signal Gn.

As shown in FIG. 3, the data processing section 100 (as shown in FIG. 2) receives the second image signal Gn of the n frame from the exterior, and reads out the first compensated signal of the $(n-1)^{th}$ frame, stored in the memory 110 (as shown in FIG. 2) (S210).

The data processing section 100 compares a differential value between the second image signal Gn and the first compensated signal G'n−1 with a predetermined first reference value V1 by using the first compensation section 120 (see FIG. 2) (S220). If the differential value between the second image signal Gn and the first compensated signal G'n−1 is greater than the first reference value V1, a predetermined first compensation factor (α) is added to the second image signal Gn, thereby generating the second compensated signal G'n (S221). Meanwhile, if the differential value between the second image signal Gn and the first compensated signal G'n−1 is equal to or smaller than the first reference value V1, a second compensated signal G'n identical to the second image signal Gn is generated (S222).

Next, the second compensated signal G'n is stored in the memory 110 (S230). The second compensated signal G'n is read out by the first compensation section 120 for a next frame ($(n+1)^{th}$ frame).

Meanwhile, the data processing section 100 compares the first compensated signal G'n−1 with a predetermined second reference value V2 by using the second compensation section 120 (see FIG. 2) (S241), and then compares the second image signal Gn with a predetermined third reference value V3 (S242) based on the comparison result. If the first compensated signal G'n−1 is smaller than the second reference value V2, and the second image signal Gn is greater than the third reference value V3, a third compensated signal G"n−1, which is greater than the first compensated signal G'n−1 by a second compensation factor (β), is generated (S251). On the other hand, if the first compensated signal G'n−1 is equal to or greater than the second reference value V2, or the second image signal Gn is equal to or smaller than the third reference value V3, a third compensated signal G"n−1 identical to the first compensated signal G'n−1 is generated (S252).

Then, the third compensated signal G"n−1 is output from the data processing section 100 and supplied to the data driving section 500 shown in FIG. 1 (S260).

In the present embodiment, the first image signal, the second image signal Gn, the first to the third reference values V1 to V3 are digital signal.

Figure 4:
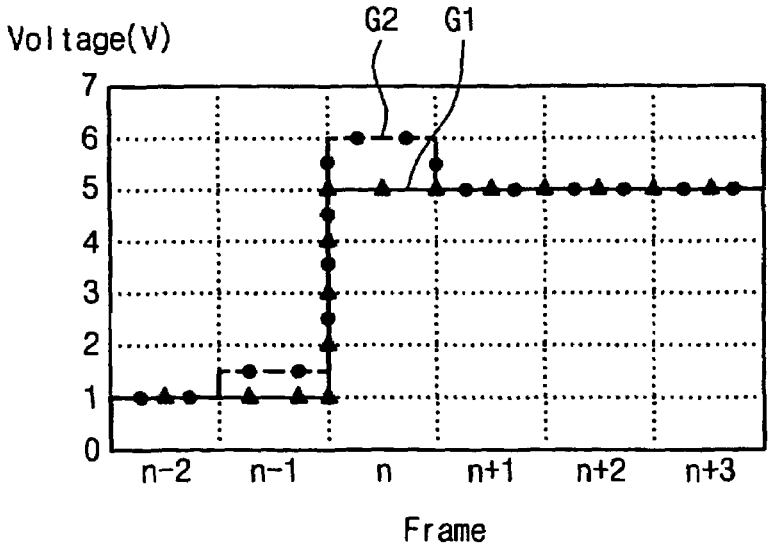
FIG. 4 is a graph showing an input signal and a compensated signal of the data processing section shown in FIG. 2.

FIG. 4 is a graph showing the input signal and calibrated signal of the data processing section as shown in FIG. 2. In FIG. 4, an x-axis represents a frame and a y-axis represents a voltage (V). The first graph G1 (e.g., —▲—) in FIG. 4 shows the image signal input to the data processing section 100 (as shown in FIG. 2), while the second graph G2 (e.g., —•—) in FIG. 4 shows the compensated signal obtained by compensating the image signal in the data processing section 200.

As shown in the first graph G1 (e.g., —▲—) in FIG. 4, the input signal is maintained at 1V during the $(n-2)^{th}$ and $(n-1)^{th}$ frames, and is maintained at 5V during the $n^{th}$ to $(n+3)^{th}$ frames. In the present exemplary embodiment, the voltage (V) is expressed with an absolute value.

As shown in the second graph G2 (e.g., —•—), the first compensation section 120 shown in FIG. 2 generates a second compensated signal (6V) of the $n^{th}$ frame according to the difference between the first compensated signal (which is 1V on the assumption that the first compensated signal is the same as the first input signal of the $(n-1)^{th}$ frame) of the $(n-1)^{th}$ frame and the second input signal (5V) of the $n^{th}$ frame. Since the difference (4V) between the first compensated signal (1V) and the second input signal (5V) is greater than a predetermined first reference value (e.g., 3.5V), the first compensation section 120 generates the second compensated signal having a voltage of about 6V, which is greater than the second input signal (5V) by a predetermined first compensation value (1V).

Additionally, the second compensation section 130 shown in FIG. 2 generates a third compensated signal (1.5V) of the $(n-1)^{th}$ frame based on both the first compensated signal (which is 1V on the assumption that the first compensated signal is the same as the first input signal of the $(n-1)^{th}$ frame) of the $(n-1)^{th}$ frame and the second input signal (5V) of the $n^{th}$ frame. Since the first compensated signal (1V) is smaller than a predetermined second reference value (1.5V) and the second input signal (5V) is greater than a predetermined third reference value (4.5V), the second compensation section 130 generates the third compensated signal having a voltage of about 1.5V, which is greater than the first compensated signal (1V) by a predetermined second compensation value (0.5V).

After that, the third compensated signal (1.5V) is applied to the pixels for the $(n-1)^{th}$ frame to pre-tilt the liquid crystal. Then, for the $n^{th}$ frame, the second compensated signal (6V), which is higher than the target voltage (5V), is applied so that the liquid crystal capacitor $C_{LC}$ can rapidly reach the target voltage (5V) for the $n^{th}$ frame, and thus the response speed of the liquid crystal can be improved.

In addition, the data processing section 100 only needs a frame memory that stores a compensated signal, i.e., compensated data in each frame. Hence, the number of memories associated with or mounted on the timing controller 600 shown in FIG. 1 can be reduced.

According to the data processing device, the method of driving the data processing device and the display device having the data processing device of the present invention, the second compensated data is generated based on both the first compensated data, which is obtained by compensating the first frame data, and the second frame data, and then the second compensated data is fedback to the memory and stored therein. Therefore, the number of memories can be reduced.

Additionally, the third compensated data is generated based on the first compensated data and the second frame data, and the third compensated data is used to pre-tilt the liquid crystal for the first frame. Therefore, the response speed of the liquid crystal can be improved.

Although the exemplary embodiments of the present invention have been described, it is understood that the present invention should not be limited to these exemplary embodiments but various changes and modifications can be made by one of ordinary skill in the art within the spirit and scope of the present invention as hereinafter claimed.

What is claimed is:

1. A data processing device comprising:

a memory outputting first compensated data based on first frame data;

a first compensation section generating second compensated data based on the first compensated data and second frame data, while storing the second compensated data in the memory after the first compensated data is output from the memory, the second compensated data being generated to be identical with the second frame data when a difference between the first compensated data and the second frame data is equal to or smaller than a predetermined first reference value and generated to be greater than the second frame data by a predetermined first compensation value when the difference between the first compensated data and the second frame data is greater than the first reference value; and a second compensation section generating third compensated data based on both the second frame data and the first compensated data.

2. The data processing device of claim 1, wherein the first frame data, the second frame data and the first reference value are digital signal.

3. The data processing device of claim 1, wherein the second compensation section generates the third compensated data greater than the first compensated data by a predetermined compensation value, when the first compensated data is smaller than a predetermined second reference value and the second frame data is greater than a predetermined third reference value, while generating the third compensated data identical to the first compensated data, when the first compensated data is equal to or greater than the second reference value, or the second frame data is equal to or smaller than the third reference value.

4. The data processing device of claim 3, wherein the first frame data, the second frame data, the second reference value and the third reference value are digital signal.

5. The data processing device of claim 1, wherein the first frame data and the second frame data are image data corresponding to contiguous first and second frames, respectively.

6. The data processing device of claim 1, wherein the memory includes a frame memory having a storage space corresponding to one frame.

7. A method of driving a data processing device, the method comprising:

reading out first compensated data obtained by compensating first frame data from a memory of the data processing device, and receiving second frame data;

generating second compensated data based on the second frame data and the first compensated data;

storing the second compensated data; and generating third compensated data based on the second frame data and the first compensated data, wherein the generating of the second compensated data comprises:

comparing a difference between the first compensated data and the second frame data with a predetermined first reference value; and generating the second compensated data identical to the second frame data, when the difference between the first compensated data and the second frame data is equal to or smaller than a predetermined first reference value, while generating the second compensated data greater than the second frame data by a predetermined first compensation value, when the difference between the first compensated data and the second frame data is greater than the first reference value.

8. The method of claim 7, wherein the generating of the third compensated data comprises:

comparing the first compensated data with a predetermined second reference value and comparing the second frame data with a predetermined third reference value; and producing the third compensated data greater than the first compensated data by a predetermined compensated value, when the first compensated data is smaller than a second reference value and the second frame data is greater than a predetermined third reference value, while producing the third compensated data identical to the first compensated data, when the first compensated data is equal to or greater than the second reference value, or the second frame data is equal to or smaller than the third reference value.

9. The method of claim 7, wherein the first frame data and the second frame data are image data corresponding to contiguous first and second frames, respectively.

10. A display device comprising:

a data processing section which generates second compensated data based on both first compensated data, which are obtained by compensating first frame data, and second frame data, and generates third compensated data based on the second frame data and the first compensated data;

a data driving section that outputs a data voltage corresponding to the third compensated data in response to data control signals;

a gate driving section that outputs a gate voltage in response to gate control signals; and a display section that displays images in response to the data voltage and the gate voltage, wherein the data processing section comprises:

a first compensation section that generates the second compensated data based on the first compensated data and second frame data, while storing the second compensated data in the memory after the memory outputs the first compensated data, and wherein the first compensation section generates the second compensated data identical to the second frame data, when a difference between the first compensated data and the second frame data is equal to or smaller than a predetermined first reference value, while producing the second compensated data greater than the second frame data by a predetermined first compensation value, when the difference between the first compensated data and the second frame data is greater than the first reference value.

11. The display device of claim 10, wherein the data processing section includes:

a memory that outputs the first compensated data;

a first compensation section that generates the second compensated data based on the first compensated data and second frame data, while storing the second compensated data in the memory after the memory outputs the first compensated data; and a second compensation section that generates third compensated data based on both the second frame data and the first compensated data.

12. The display device of claim 11, wherein the second compensation section generates the third compensated data greater than the first compensated data by a predetermined compensation value, when the first compensation data is smaller than a second reference value and the second frame data is greater than a predetermined third reference value, while producing the third compensated data identical to the first compensated data, when the first compensated data is equal to or greater than the second reference value, or the second frame data is equal to or smaller than the third reference value.

13. The display device of claim 10, wherein the first frame data and the second frame data are image data corresponding to contiguous first and second frames, respectively.

14. The display device of claim 10, further comprising a timing controller that supplies data control signals to the data driving section in response to control signals from an exterior, and supplies the gate control signals to the gate driving section.

15. The display device of claim 14, wherein the data processing section is accommodated in the timing controller.

16. The display device of claim 10, wherein the display section includes a pixel that receives the data voltage and the gate voltage, in which the pixel includes:

a thin film transistor that outputs the data voltage in response to the gate voltage; and a liquid crystal capacitor charged with a voltage corresponding to a potential difference between the data voltage and a predetermined reference voltage.

* * * * *